US006318104B1

(12) United States Patent
Moraes et al.

(10) Patent No.: US 6,318,104 B1
(45) Date of Patent: Nov. 20, 2001

(54) WINDOW ROOM AIR CONDITIONER

(75) Inventors: Luciano da Luz Moraes, Canoas; Juan Carlos Carne Correa, Porto Alegre; Daniel Alessandro Oliveira de Barros, Novo Hamburgo, all of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/554,053

(22) PCT Filed: Sep. 16, 1998

(86) PCT No.: PCT/BR98/00074

§ 371 Date: May 9, 2000

§ 102(e) Date: May 9, 2000

(87) PCT Pub. No.: WO00/16013

PCT Pub. Date: Mar. 23, 2000

(51) Int. Cl.[7] ..... F25D 23/12; F25D 19/00
(52) U.S. Cl. ..... 62/262; 62/298
(58) Field of Search ..... 62/262, 263, 298, 62/259.1, 77, 429

(56) References Cited

U.S. PATENT DOCUMENTS

| | | | | |
|---|---|---|---|---|
| 5,081,849 | | 1/1992 | Thompson et al. | 62/262 |
| 5,415,011 | * | 5/1995 | Gilmore et al. | 62/262 |
| 5,622,058 | | 4/1997 | Ramakrishnan | 62/295 |
| 5,638,693 | | 6/1997 | Baek Sang Kyun | 62/262 |
| 5,687,583 | * | 11/1997 | Tunekawa et al. | 62/404 |

FOREIGN PATENT DOCUMENTS 2275330 8/1994 (GB) .

* cited by examiner

*Primary Examiner*—Henry Bennett
*Assistant Examiner*—Chen Wen Jiang

(57) ABSTRACT

A room air conditioner unit of the type having a basepan, which is divided into indoor and outdoor sections by a partition. The indoor section includes an evaporator coil, an evaporator fan and a scroll for directing indoor air flow. The outdoor section includes a compressor, a condenser coil, a condenser fan, a condenser fan shroud and an electric motor. The motor is configured to drive both the evaporator and condenser fans. A first partition wall section is attached to the basepan and has a height less than the overall height of the partition. A first condenser fan shroud section is also attached to the basepan and has a height less than the overall height of the condenser fan shroud. A molded component having a top wall is configured to overlie at least a portion of both the indoor section and the outdoor section. The top wall has, integrally formed therewith, a downwardly extending partition wall section. The second partition wall section is configured to cooperate with the first wall section to define the partition. The top wall further has integrally formed therewith a downwardly extending second condenser fan shroud section, which is configured to cooperate with the first condenser fan shroud section to define the condenser fan shroud. Means are provided for attaching the molded component to both the first partition wall section and the first condenser fan shroud section.

5 Claims, 9 Drawing Sheets

WINDOW ROOM AIR CONDITIONER

TECHNICAL FIELD

The present invention is directed to air conditioners and, more particularly, to the assembly of window room air conditioning units.

BACKGROUND ART

Air conditioning units such as so-called "window room air conditioners" are commonly used for residential and similar applications and generally include closed refrigeration circuits having an evaporator and a condenser. The unit is normally divided by a partition into an evaporator section and a condenser section, the evaporator section communicating with the room air to be conditioned and the condenser section communicating with external air such as outdoor air. Refrigerant flows through the refrigerant circuit absorbing heat from the room air at the evaporator and discharging heat energy to the external air at the condenser. The conventional refrigeration circuit is completed by the addition of a compressor, an expansion device, and the appropriate connections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The outdoor section of the housing includes a plurality of openings in the sides and top thereof, which serve as inlet openings for cooling air which flows into the outdoor section and outwardly therefrom after passing through the condenser coil, which is mounted vertically in the back of the outdoor section.

In addition to the components mentioned above, the outdoor section also typically includes an outdoor fan and fan orifice, as well as an electric motor, which typically also drives an indoor fan. The indoor section also typically includes the aforementioned indoor fan, an indoor fan orifice, a control box and a fan scroll structure for directing the air cooled by the evaporator back into the room to be cooled. Each of the aforementioned components requires means for attaching it to the basepan and/or other structure of the air conditioning unit. Numerous approaches are known for assembly of the components in a manner which will minimize the number of individual components required for assembly of the unit. The fewer components, and the fewer number of attachment means, results in lower material costs, less labor content and, accordingly, a less expensive unit.

DISCLOSURE OF THE INVENTION

A room air conditioner unit of the type having a basepan, which is divided into indoor and outdoor sections by a partition. The indoor section includes an evaporator coil, an evaporator fan and a scroll for directing indoor air flow. The outdoor section includes a compressor, a condenser coil, a condenser fan, a condenser fan shroud and an electric motor. The motor is configured to drive both the evaporator and condenser fans. A first partition wall section is attached to the basepan and has a height less than the overall height of the partition. A first condenser fan shroud section is also attached to the basepan and has a height less than the overall height of the condenser fan shroud. A molded component having a top wall is configured to overlie at least a portion of both the indoor section and the outdoor section. The top wall has, integrally formed therewith, a downwardly extending partition wall section. The second partition wall section is configured to cooperate with the first wall section to define the partition. The top wall further has integrally formed therewith a downwardly extending second condenser fan shroud section, which is configured to cooperate with the first condenser fan shroud section to define the condenser fan shroud. Means are provided for attaching the molded component to both the first partition wall section and the first condenser fan shroud section.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
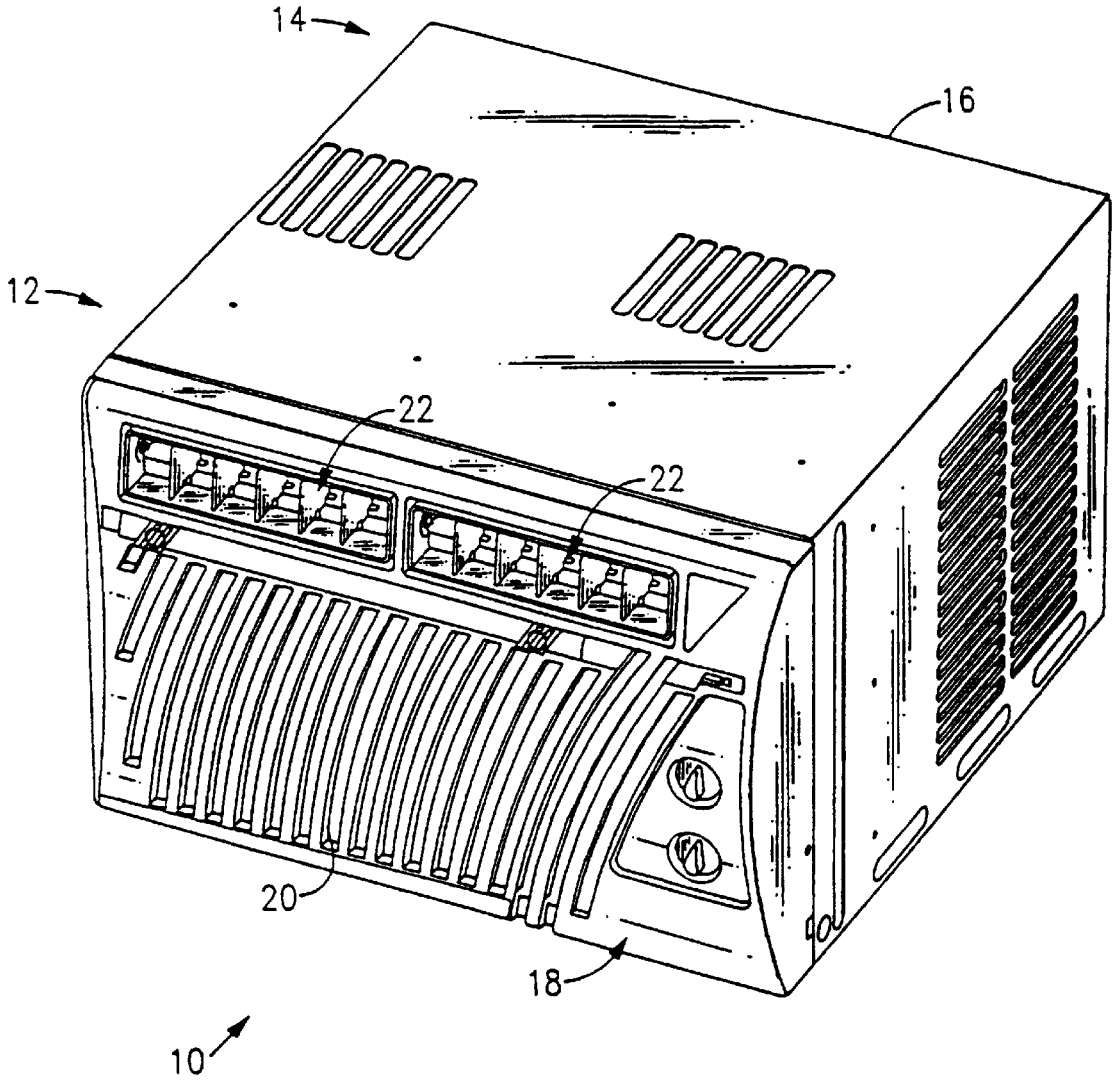
FIG. 1 is a front perspective view of a room air conditioner, which embodies the features of this invention.

FIG. 1 illustrates a room air conditioner unit 10, which includes, generally, an indoor section 12 and outdoor section 14. The room air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes an indoor grille section 18, which includes inlet louvers 20 and a pair of air discharge assemblies 22.

Figure 2:
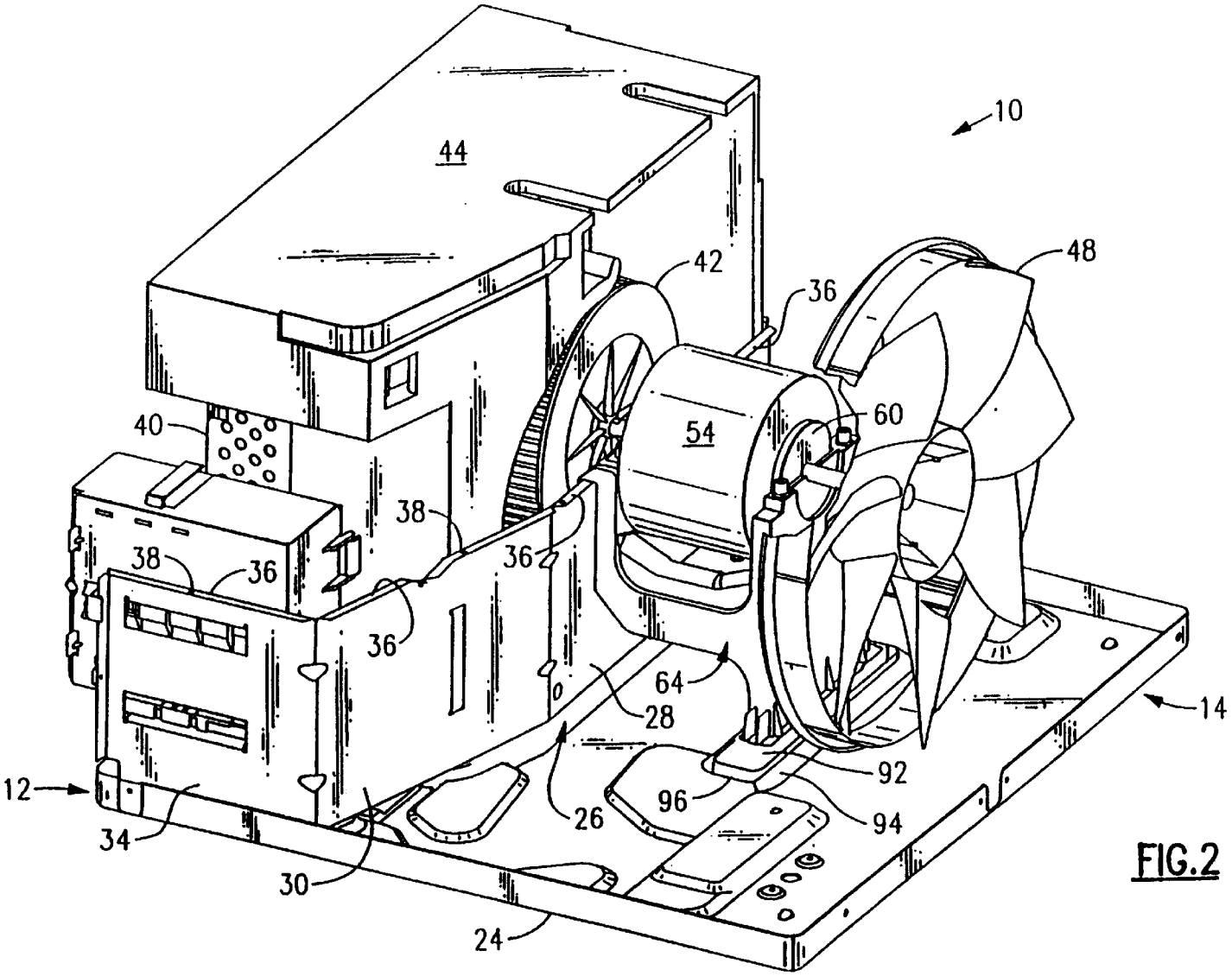
FIG. 2 is a rear perspective view of the air conditioning unit of FIG. 1 with the outer housing front grille and a number of the internal components removed therefrom.
Figure 9:
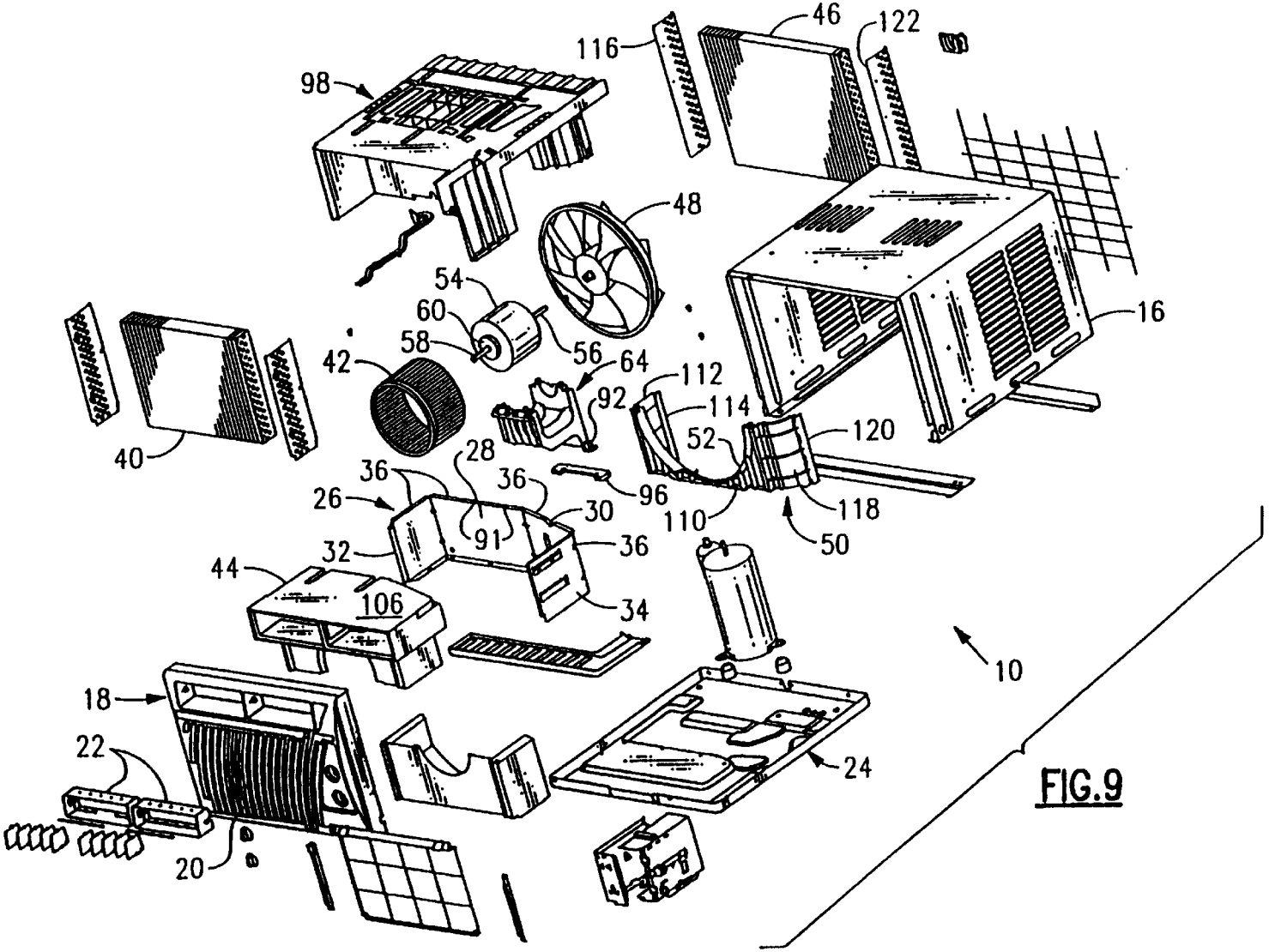
FIG. 9 is an exploded view of the air conditioning unit illustrated in FIG. 1.
Figure 10:
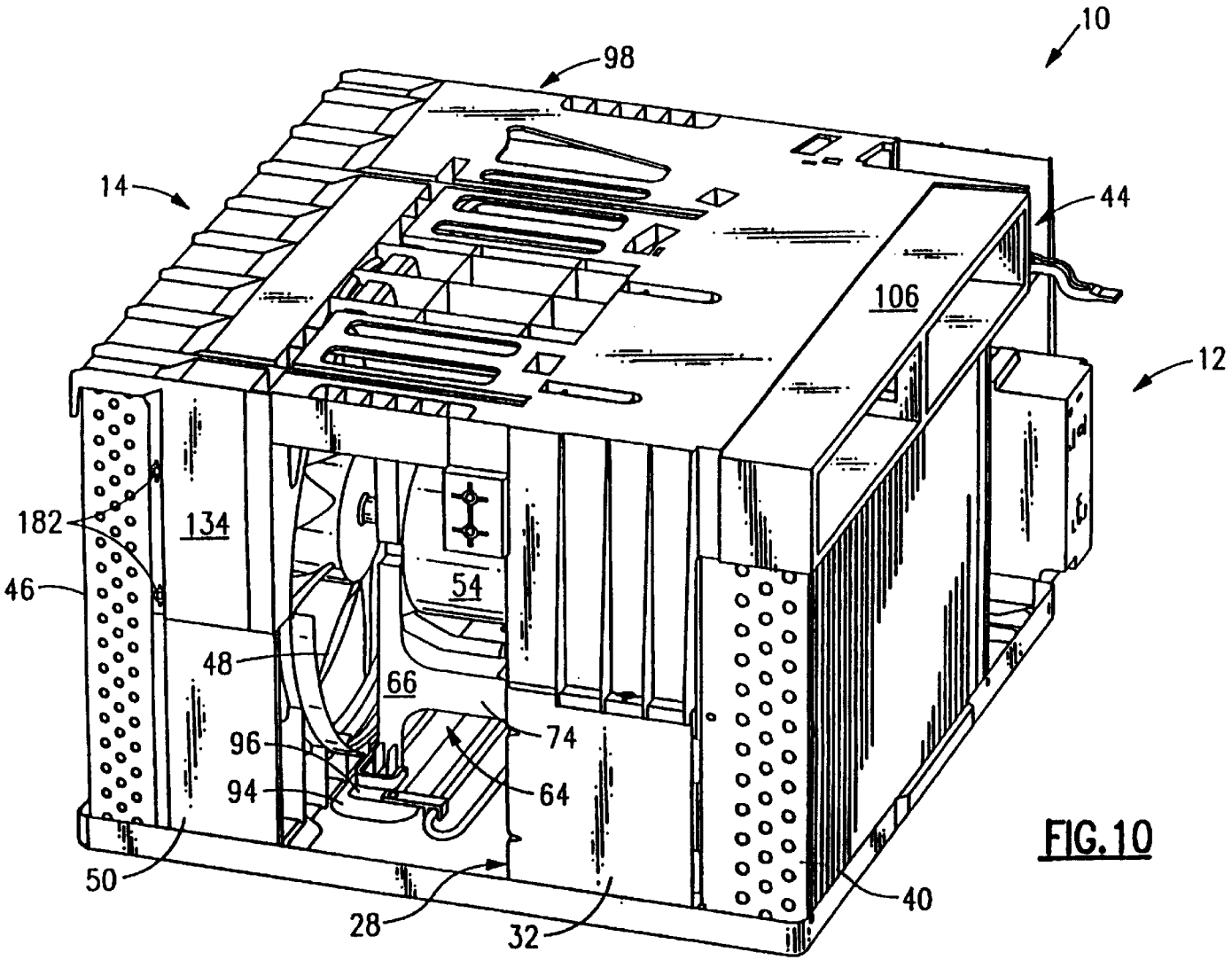
FIG. 10 is a perspective view viewed from the left front side of the air conditioning unit of FIG. 1 with the housing and front grille removed therefrom.

Looking now at FIGS. 2, 9 and 10, the components of both the indoor section 12 and outdoor section 14 are supported in a rectangular basepan 24. The indoor and outdoor sections are separated by a vertically extending metal partition. A sheet metal structure forming the lower half 26 of the partition is illustrated assembled to the basepan in FIG. 2. As seen in FIGS. 2 and 9, the metal partition comprises a major planar section 28 extending transversely to the air conditioning unit, a second partially angularly disposed yet transversely extending section 30, and left and right-hand end sections 32 and 34 which extend forwardly from the transverse sections 28 and 30 to define in part the indoor section 12 of the unit. Each of the wall sections 28, 30, 32 and 34 of the partition 26 have a horizontally extending flange, collectively 36, formed at the upper ends thereof. Each of these flanges 36 is provided with one or more openings therein for receiving a threaded fastener therethrough.

Figure 12:
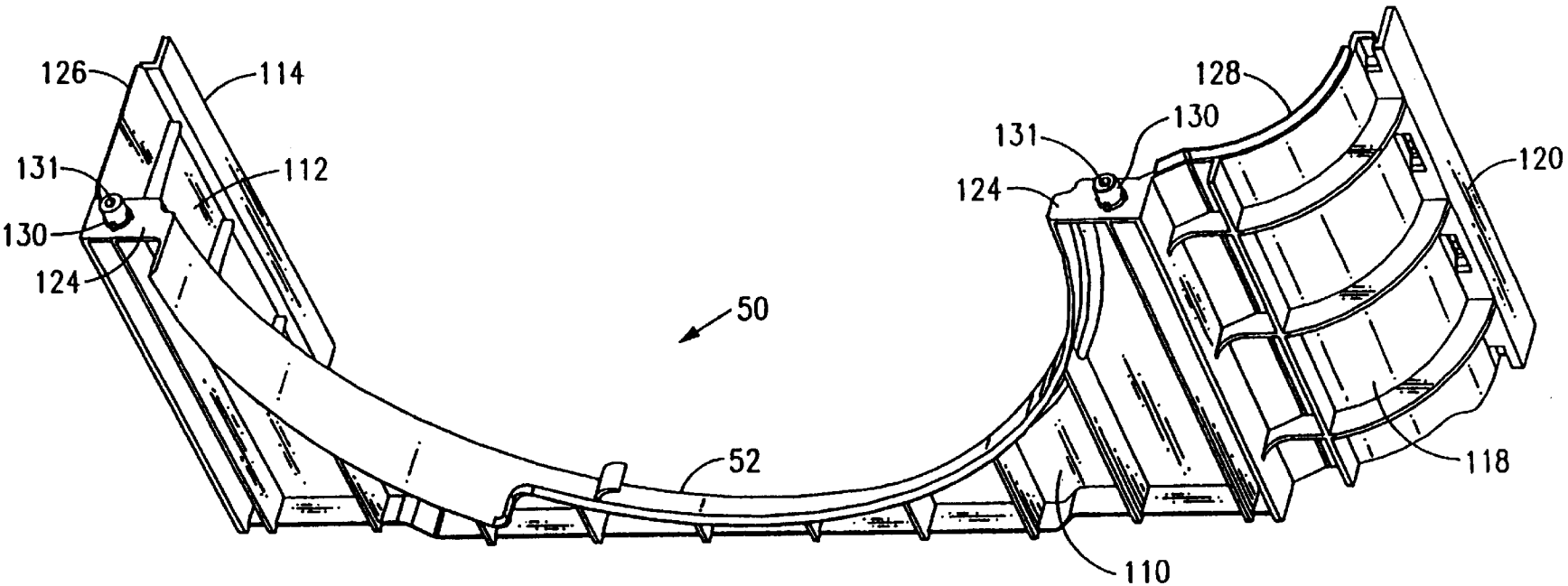
FIG. 12 is an enlarged perspective view of the lower fan shroud of the air conditioner unit illustrated in FIG. 1.

The indoor section of the unit comprises basically an evaporator coil 40 vertically disposed at the front end thereof, an evaporator or indoor fan 42 located behind the evaporator, and an air directing scroll 44. The outdoor section 14 includes a condenser coil 46 vertically disposed adjacent the back end thereof, and a condenser fan 48 located within the outdoor section adjacent the condenser coil. The lower half 50 of a condenser fan shroud, shown in detail in FIG. 12, is connected to the condenser coil 46 and the basepan 24. The condenser fan shroud defines one-half of a condenser fan inlet orifice 52. The condenser fan 48 is of the axial, shrouded propeller type and is connected to an electric motor 54 via drive shaft 56. A drive shaft 58 extending from the other side of the electric motor is connected to the evaporator fan 42 such that both of fans 42 and 48 are commonly driven.

As best shown in FIGS. 2 and 9, the electric motor 54 is provided with a large rubber bushing 60 structurally attached to the motor casing on opposite sides thereof surrounding each of the motor shafts 56 and 58. The lower half of each of the rubber bushings 60 are adapted to be received in spaced apart semi-circular conformations 62 formed in a motor mounting pedestal 64. The motor mounting pedestal 64 is shown in detail in FIG. 11, as comprising a one-piece substantially "Y" shaped component having a vertically extending rear wall 66. The rear wall carries at its upper end one of the semi-circular bushing engaging conformations 62 and spaced apart upwardly extending surfaces 68 having upwardly extending structural positioning and attaching pins 70 formed thereon. Each of the pins 70 has a central opening 72 extending therethrough adapted to receive a threaded fastener therein. Extending forwardly from the wall 66 is a central saddle-like section 74 which defines the space for the motor housing and which has a front wall 76 extending vertically upwardly therefrom.

The upper end of the front wall 76 defines an inverted U-shaped hook-like structure 78, which defines a downwardly facing surface 80 which is adapted to engage the top of the flange 36 of the section 28 of the metal partition 26. The free end 82 of the hook-like structure 78 extends downwardly on the inside section side of the wall section 28. As with the rear wall, the top 84 of the front wall 76 includes a pair of upstanding mounting pins 86 having openings 88 therethrough. Also provided in the top 84 of the front wall 76 are a pair of through openings 90 which are configured to align with the openings 91 provided in the flange 36 of the wall 28 and to receive threaded fasteners therethrough to thereby attach the hook-like element 78 to the partition.

Figure 11:
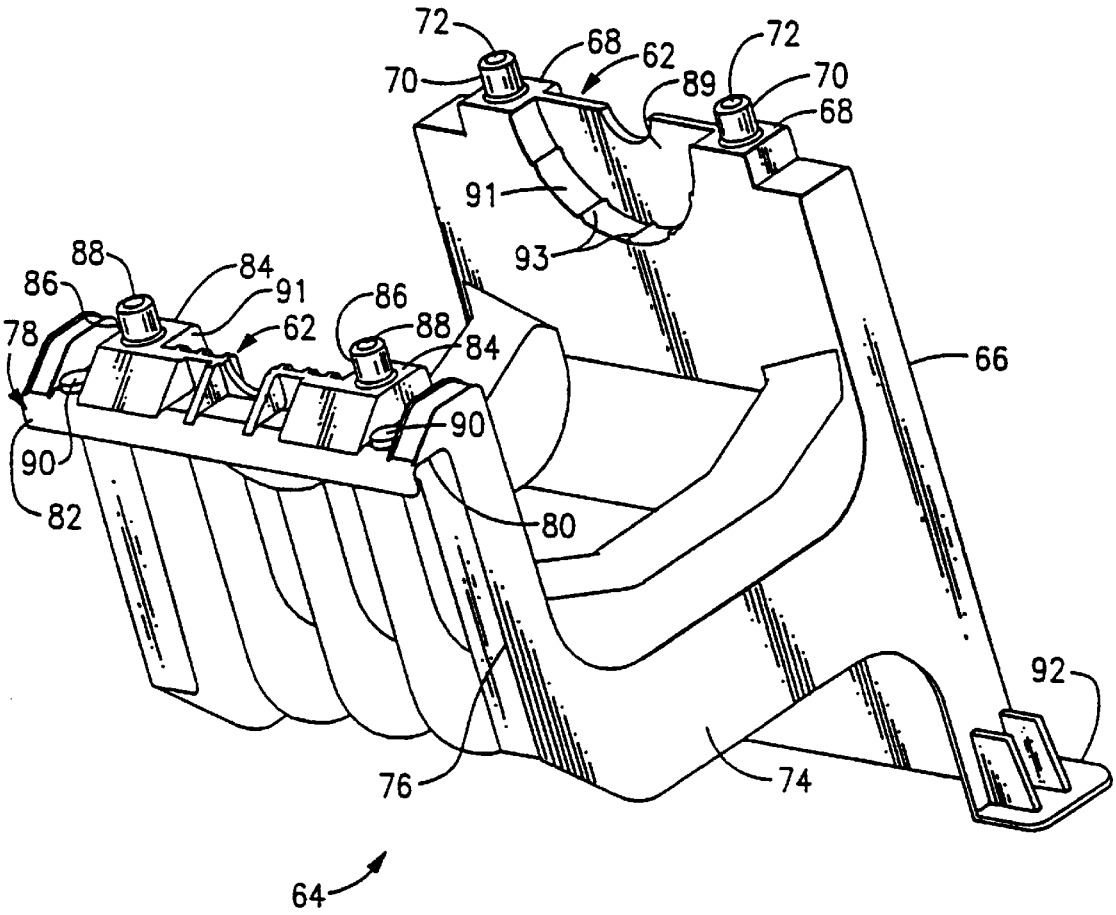
FIG. 11 is an enlarged perspective view of the motor mount pedestal according to the present invention.

The front wall 76 also contains the other semi-circular motor bushing receiving conformation therein. While the conformation in the front wall is not shown in detail in the drawings, it is identical to the conformation in the rear wall 66. As shown in FIG. 11, the conformation includes a back wall 89 and an arcuate support surface 91, which includes a number of axially extending ridges 93 configured to engage the outer peripheral surface of the bushings and prevent rotation thereof.

The lower end of the rear wall 66 is provided with an enlarged base section 92, which is adapted to engage a raised portion 94 formed in the basepan 24. A rubber vibration isolating pad 96, as best seen in FIG. 9, is adapted to be positioned between the enlarged base 92 and the supporting structure 94 on the basepan. As will be seen, a large one-piece molded plastic component 98 is configured to cooperate with the motor mounting pedestal 64 to complete the attachment of the motor and fans.

With the exception of the outer housing 16, the front grille 18 and the large molded component 98, all of the other components of the air conditioner unit are positioned in the basepan 24 in a conventional manner. Not conventional, however, is the fact that there are no major structural mounting frameworks, components and struts or the like attaching the components to the basepan and to one another. Alignment of the components of the air conditioner with respect to one another and the positioning of the components within the unit are accomplished by the lowering in place of the one-piece upper component 98, and the attachment of that component by way of threaded fasteners to the other components. Most of the threaded fasteners, it will be seen, extend downwardly from the top of the molded component.

The metal component 98 is molded from a structural plastic material and defines a substantially planar top wall 100. The top wall has a horizontally extending back section 102, which is configured to overly the top of the condenser coil 46, and a front section 104 adapted to overly the top 106 of the indoor section scroll 44.

Figure 4:
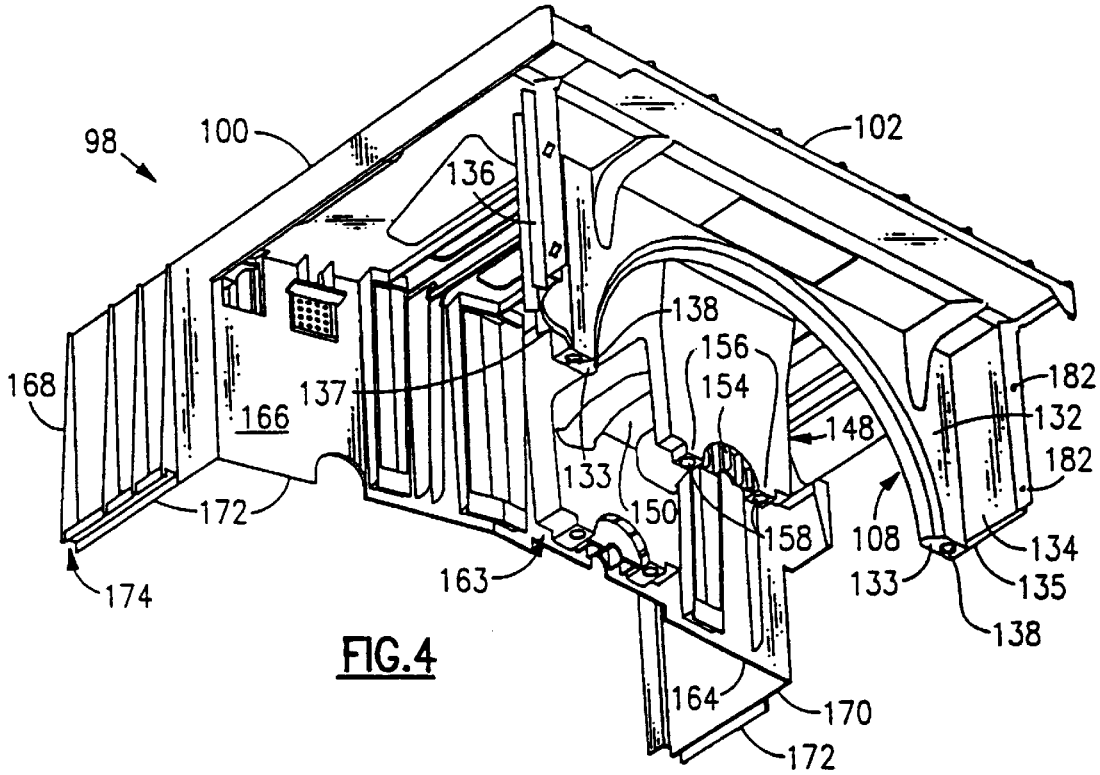
FIG. 4 is a bottom perspective view of the component illustrated in FIG. 3.
Figure 5:
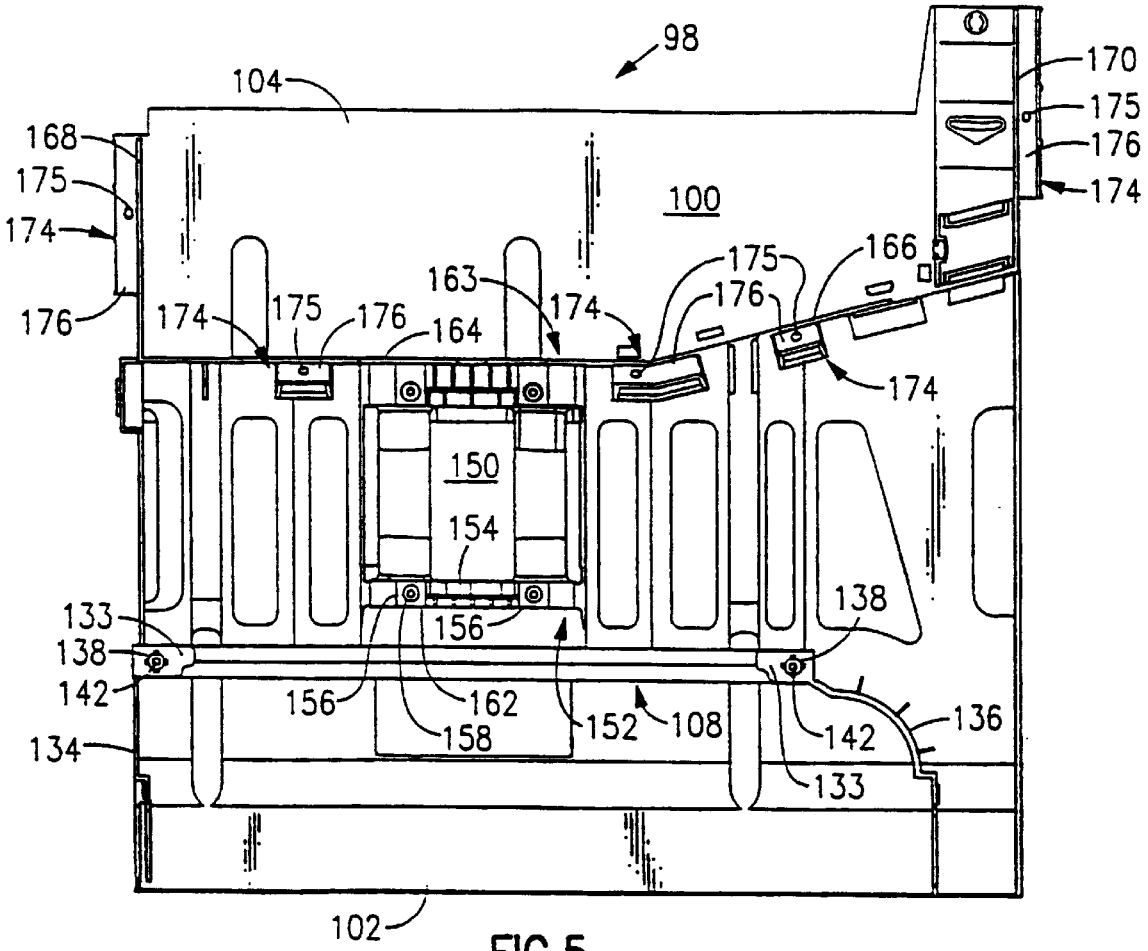
FIG. 5 is a bottom view of the one-piece component illustrated in FIG. 3.
Figure 7:
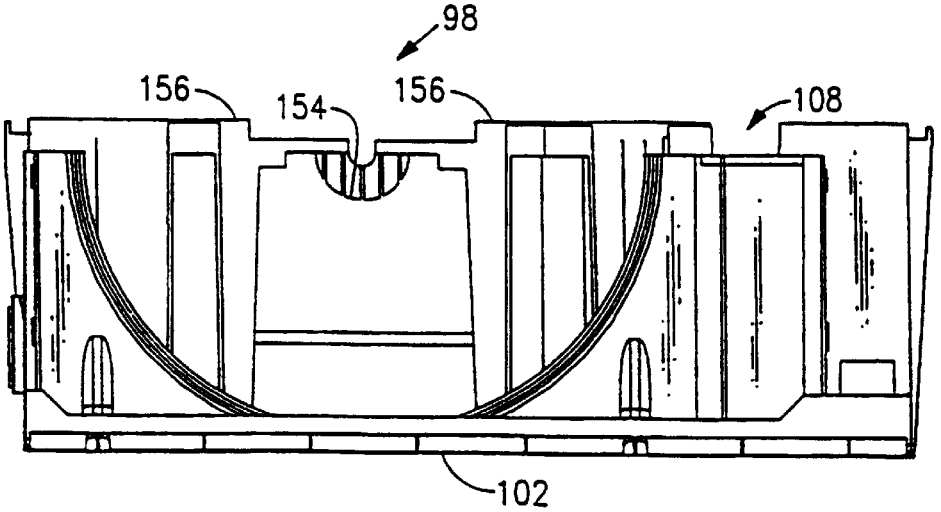
FIG. 7 is a front view of the component as viewed relative to FIG. 5.

As best seen in FIG. 4, extending downwardly from the interior of the top wall 100 at a location forwardly of the condenser retaining section 102 is the upper half 108 of the condenser fan shroud. The previously referenced lower condenser fan shroud 50 is illustrated in detail in FIG. 12 and includes a main wall section 110 in which one-half of the inlet orifice 52 is formed. Extending rearwardly from the left-hand side of the main wall section 110 is a left side wall 112, which has formed on its rear edge 114 thereof structure for engaging the left-hand tube sheet 116 of the condenser coil 46. Extending from the right-hand side of the main wall section 66 is a curved wall 118, which extends to the right and rear and terminates in a rear edge 120, which includes structure thereon for engaging the right-hand tube sheet 122. The main wall 110, the left side wall 112, and the right side wall 118 each define an upper edge 124, 126 and 128, respectively. The upper edge 124 of the main wall section 110 is split into two small portions, each of which carries an upstanding positioning and attaching pin 130, which has an axial opening 131 extending therethrough.

Figure 3:
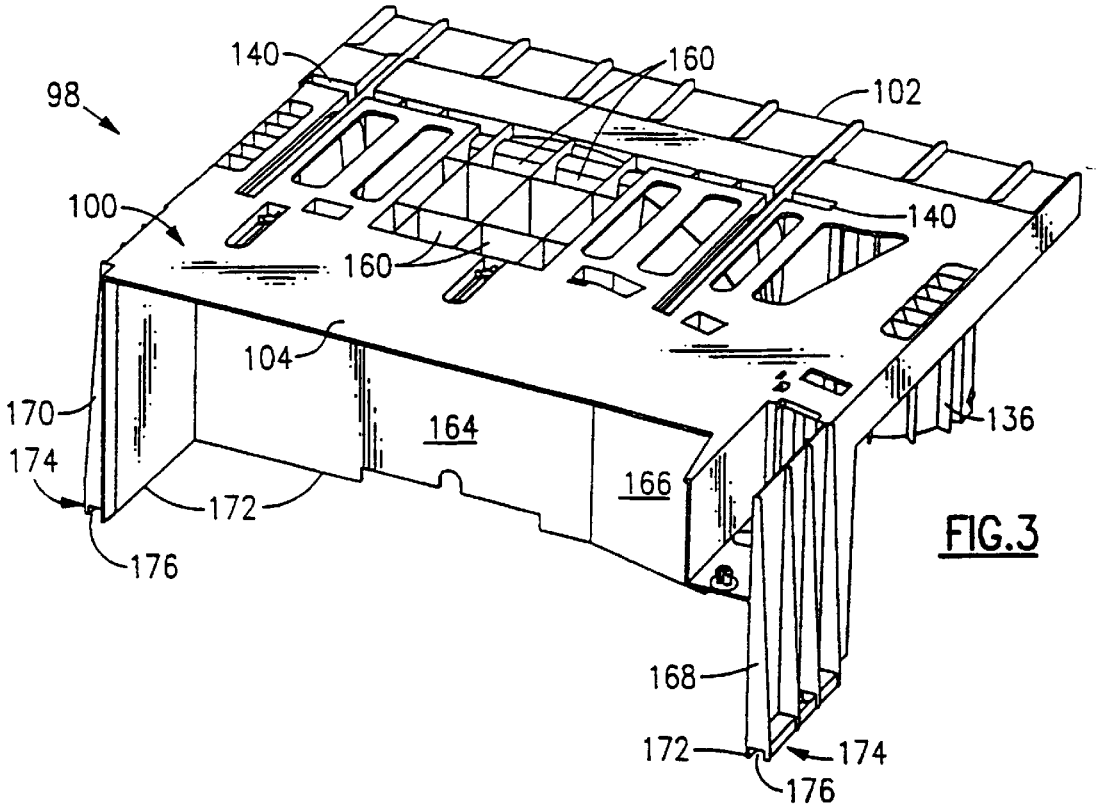
FIG. 3 is a top front perspective view of a one-piece molded component, according to the present invention.

In a like manner, the upper section 108 of the condenser fan shroud carried by the component 98 includes a main wall section 132, a left-hand side wall 134 and a right-hand side wall 136, which are configured substantially identically to the main wall 110, the left side wall 112 and the right side wall 118 of the lower section 50, respectively. Each of the walls 132, 134 and 136 of the upper section define a downwardly facing edge 133, 135 and 137, respectively, which is configured to sealingly engage the mating edges 110, 112 and 118 of the lower section. The mating edges 133 of the upper main wall 132 are provided with recesses 138 therein, which are adapted to receive the upstanding pins 130 carried by the upper edge of the main wall 110 of the lower section. Further, as best seen in FIG. 3, the region of the component 98 overlying the recesses 138 is hollow, thus defining access openings 140 extending from the top wall 100. The lower ends of each of the access openings 140 defines a structural wall overlying the recesses 138 in which is formed a small diameter opening 142 adapted to receive a threaded fastener therethrough which, in turn, is adapted to be received in the axially aligned openings 131 provided in the pins 130 of the lower condensate fan shroud section 108.

Also extending downwardly from the interior of the top wall 100 is an inverted U-shaped structure 148, which forms the upper portion of the motor mounting structure. The motor mount 148 includes a central open region 150 adapted to receive the motor housing therein and which is bounded by vertically downwardly extending rear wall 152 and front wall 164.

The rear wall 152 is adapted to align with and cooperate with the rear wall 66 of the motor mounting pedestal 64. The lower end of the rear wall, accordingly, is provided with a semi-circular motor bushing engaging conformation 154 and a pair of downwardly facing surfaces 156 on opposite sides of the conformation 154. The surfaces 156 include recesses 158 therein configured to receive the mounting pins 70 carried by the motor mounting pedestal 64. As with the recesses 138 described in connection with the condenser fan shroud, the molded component 98 is provided with access openings 160 from the top wall 100 thereof to provide access through receiving openings 162 formed in the recesses 158 to facilitate passage of a threaded fastener therethrough and into the opening 72 in the tops of the pins 70. The front wall 163 of the upper motor mount 148 is configured substantially identically to the rear wall 152 and, accordingly, engages the mating structure on the front wall 76 of the motor mounting pedestal in an identical manner, as the rear wall is described above.

Finally, extending downwardly from the top wall 100 of the molded component 98 is the upper half of the partition which cooperates with the metal partition 26 mounted in the basepan to define the partition dividing the indoor and outdoor sections of the air conditioning unit. The upper partition includes a main transversely extending section 164, which corresponds to the section 28 of the metal partition, a second substantially transversely extending section 166, which correspond to the section 130 of the metal partition, a right wall section 168 corresponding to the right wall 32 of the metal partition and, finally, a left wall 170 which corresponds with the left wall 34 of the metal partition. Each of the walls 164, 166, 168 and 170 has a downwardly extending substantially continuous lip, collectively 172, which is configured to extend in confronting relationship with the indoor section side of the mating walls of the metal partition to assure a structural and air tight connection therebetween. Located on the lower edge of each of the walls on the outside section thereof are five attachment conformations, of varying lengths, each bearing reference numeral 174 and each presenting a downwardly facing surface 176 upwardly spaced from the lower edge of the sealed flange 172. The downwardly facing surfaces 176 are adapted to engage the tops of the flanges 36 associated with the wall sections of the metal partition 26. Each of the downwardly facing surfaces of the attachment conformations 174 has a structural thickness and openings 175 therethrough which are accessible from the top wall 100 and which is further positioned to be in axial alignment with the holes 38 provided in the flanges 36. Threaded fasteners thus may be passed through the openings 175 and into threaded engagement with the openings 38 in the flanges to thereby interconnect the upper and lower partition sections.

Figure 8:
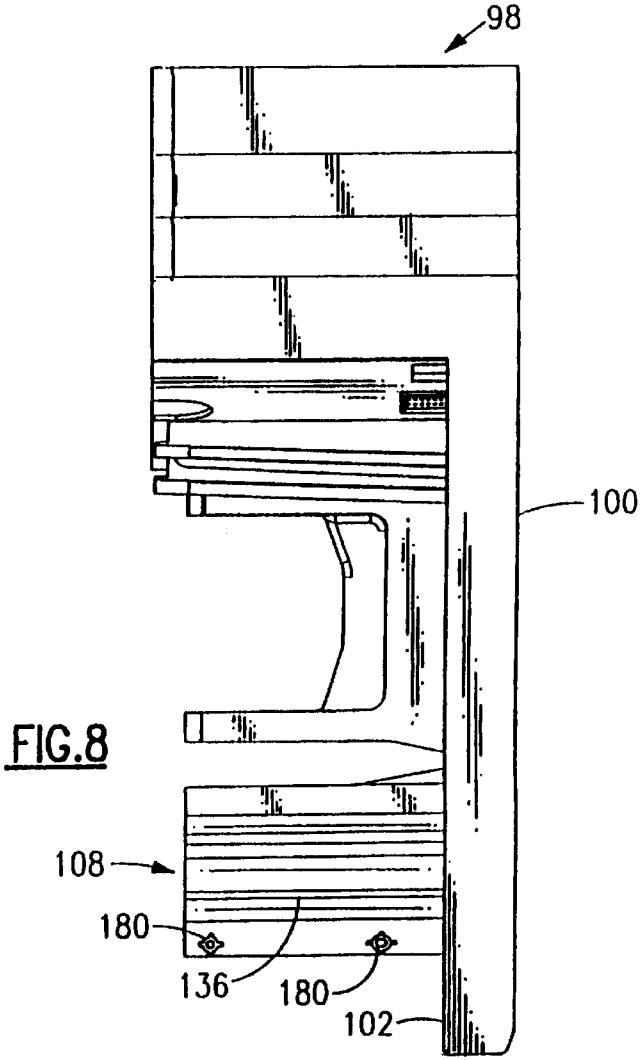
FIG. 8 is a right side view of the component as viewed relative to FIG. 5.
Figure 6:
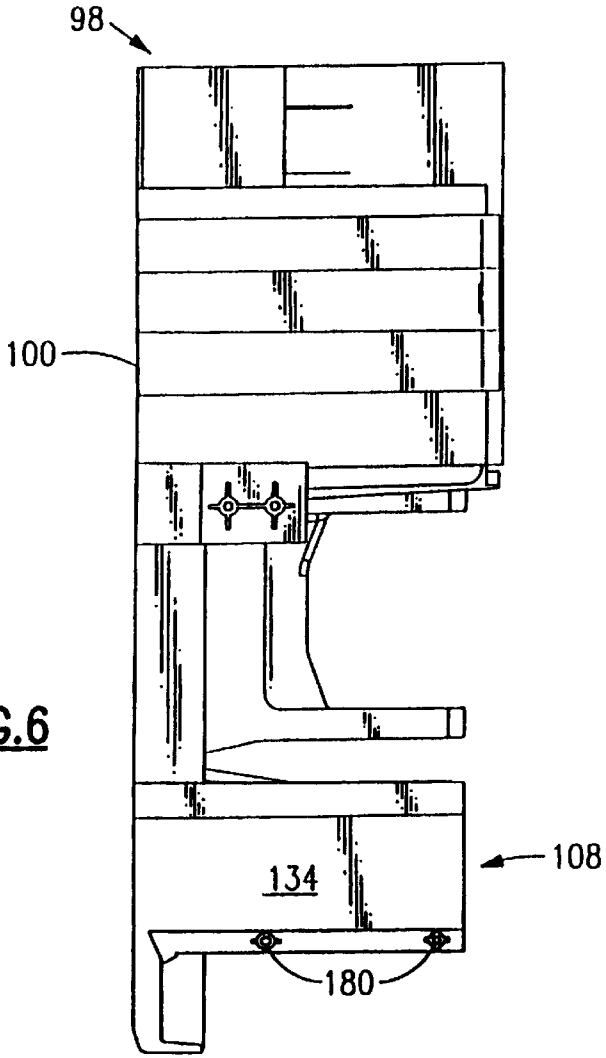
FIG. 6 is a right side view of the component, as viewed relative to FIG. 5.

With reference to FIGS. 6, 8 and 10, final assembly of the molded component 98 to the air conditioner unit is achieved by inserting threaded fasteners 180 through openings 182 in the left and right side walls 134 and 136 and into axially aligned openings (not shown) in the left and right tube sheets of the condenser coil. Completion of assembly of the air conditioning unit is then carried out by installation of the outer sheet metal housing 16 and the grille section 18.

What is claimed is:

1. A room air conditioner unit of the type having a basepan, which is divided into indoor and outdoor sections by a partition, the indoor section including an evaporator coil, an evaporator fan, and a scroll for directing indoor air flow, the outdoor section including a compressor, a condenser coil, a condenser fan, a condenser fan shroud, and an electric motor configured to drive both the evaporator and condenser fans, wherein the improvement comprises:

a first partitioned wall section attached to said basepan and having a height less than the overall height of the partition;

a first condenser fan shroud section attached to said basepan and having a height less than the overall height of said condenser fan shroud;

a molded component having a top wall configured to overlie at least a portion of both said indoor section and said outdoor section, said top wall having integrally formed therewith, a downwardly extending second partition wall section which is configured to cooperate with said first partition wall section to define said partition;

said top wall further having integrally formed therewith a downwardly extending second condenser fan shroud section, which is configured to cooperate with said first condenser fan shroud section to define said condenser fan shroud;

means for attaching said molded component to both of said first partition wall section and said first condenser fan shroud section.

2. The apparatus of claim 1 including lower fan motor support structure, said support structure having means associated therewith for attaching said support structure to said first partition wall section, said support structure having at least two upwardly facing motor support surfaces thereon which are configured to receive and support a lower part of a cooperating structure formed on said fan motor;

wherein said top wall has upper fan support structure integrally formed therewith and extending downwardly in overlying relation with said lower fan support structure, said upper fan support structure having downwardly facing motor support surfaces formed thereon which are configured to receive and support the upper part of said cooperating structure formed on said fan motor; and means for attaching said upper motor support structure to said lower motor support structure.

3. The apparatus of claim 2 wherein said top wall has a planar section on the back side thereof configured to overlie and retain said condenser coil.

4. The apparatus of claim 2 wherein said top wall has a planar section on the front side thereof configured to overlie and retain said air directing scroll.

5. The apparatus of claim 2 wherein said cooperating structure formed on said fan motor comprises a rubber bushing structurally attached to opposite sides of said fan motor; and wherein both said upwardly facing motor support surfaces and said downwardly facing motor support surfaces comprises arcuate surfaces configured to engage said rubber bushings, said arcuate surfaces having a plurality of ridges formed therein to facilitate engagement with said bushings.

* * * * *